US006861142B1

(12) United States Patent
Wilkie et al.

(10) Patent No.: US 6,861,142 B1
(45) Date of Patent: Mar. 1, 2005

(54) CONTROLLING THE DISSOLUTION OF DISSOLVABLE POLYMER COMPONENTS IN PLURAL COMPONENT FIBERS

(75) Inventors: Arnold E. Wilkie, Merritt Island, FL (US); Ben F. Shuler, Indialantic, FL (US); Tony Owen, Indialantic, FL (US); Brian C. Johnston, Melbourne, FL (US)

(73) Assignee: Hills, Inc., W. Melbourne, FL (US)

( * ) Notice: Subject to any disclaimer, the term of this patent is extended or adjusted under 35 U.S.C. 154(b) by 0 days.

(21) Appl. No.: 10/455,813

(22) Filed: Jun. 6, 2003

Related U.S. Application Data

(60) Provisional application No. 60/385,879, filed on Jun. 6, 2002.

(51) Int. Cl.[7] ..... D01F 8/00

(52) U.S. Cl. ..... 428/373; 428/397; 428/374

(58) Field of Search ..... 428/373, 374, 428/397, 372; 623/1.42

(56) References Cited

U.S. PATENT DOCUMENTS 3,700,545 A * 10/1972 Matsui et al. ..... 428/374
3,718,534 A 2/1973 Okamoto et al.
5,162,074 A 11/1992 Hills
6,551,353 B1 * 4/2003 Baker et al. ..... 623/1.42

FOREIGN PATENT DOCUMENTS

JP 10060731 A 3/1998

* cited by examiner

*Primary Examiner*—N. Edwards
(74) *Attorney, Agent, or Firm*—Edell, Shapiro & Finnan, LLC

(57) ABSTRACT

The dissolution of dissolvable components in plural component polymer fibers is achieved by providing a polymer fiber including at least two sections, where at least one fiber section includes a dissolvable component. The rate at which at least part of the fiber dissolves is controlled by at least one of a fiber section having a non-round cross-sectional geometry, and at least two fiber sections including two different dissolvable components. In an exemplary embodiment, island-in-the-sea fibers are formed with non-round and elongated cross-sectional geometries. In another embodiment, sheath-core fibers are formed in which the sheath and core include different dissolvable components.

21 Claims, 2 Drawing Sheets

CONTROLLING THE DISSOLUTION OF DISSOLVABLE POLYMER COMPONENTS IN PLURAL COMPONENT FIBERS

CROSS REFERENCE TO RELATED APPLICATIONS

This application claims priority from U.S. Provisional Patent Application Ser. No. 60/385,879, entitled "Method to Shorten Dissolving Time for Islands-In-A-Sea Fibers", filed Jun. 6, 2002. The disclosure of this provisional patent application is incorporated herein by reference in its entirety.

BACKGROUND OF THE INVENTION

1. Field of the Invention

The present invention relates to the production of plural component fibers with dissolvable polymer components.

2. Description of the Related Art

Plural component fibers with dissolvable components are useful for a variety of applications. For example, islands-in-the-sea (I/S) fibers having a dissolvable sea section are often formed as intermediate products for forming ultra-fine fibers (e.g., fibers having cross-sectional dimensions in the micrometer or nanometer range) for certain textile applications. Techniques for forming ultra-fine fibers utilizing extruded I/S fibers as precursors to forming the ultra-fine fibers are typically more effective than other known techniques, such as meltblowing, electrospinning and fiber splitting. In a typical I/S technique, ultra-fine fibers are produced by combining the high production rates of normal melt spinning to form the I/S fibers, followed by separation of the island sections to form the ultra-fine fibers by dissolving the sea section of the I/S fibers.

While the I/S process is highly effective and desirable in producing ultra-fine fibers, there are certain problems associated with this process. In particular, the costs associated with the sacrificial polymer (i.e., the sea section) required to form a conventional I/S fiber having a round cross-sectional geometry can adversely impact the economies associated with producing the resultant ultra-fine fibers. In addition, it becomes increasingly difficult to separate island sections from the sea section to form the ultra-fine fibers as the number of island sections within an I/S fiber increases. Further, the time required for separating island sections by dissolving away the sea section in a conventional I/S fiber could be detrimental to the resultant ultra-fine fibers. For example, bicomponent combinations of polyester (PET)/easy soluble polyester (ESPET) are utilized in many textile I/S fiber applications, where ESPET forms the sea section and PET forms the island sections. After formation of the I/S fibers, the ESPET sea section is dissolved away from the PET island sections in a suitable solvent (e.g., sodium hydroxide). However, if the ESPET sea section dissolves too slowly, the solvent can also dissolve some of the PET island sections before they are sufficiently removed from the ESPET sea section. In such a scenario, it would be desirable to effectively control the rate of dissolution of the ESPET sea section to ensure separation of the PET island sections with minimal or no dissolution to PET island sections.

Plural component fibers having two or more fiber sections including dissolvable components that dissolve at varying rates would also be desirable for use in fields other than textile applications. For example, a plural component fiber that includes two or more sections that can be dissolved at selected rates would be useful for certain medical applications that require a controlled exposure or release of a particular component disposed within the fiber.

Thus, it is desirable to provide a plural component fiber that includes one or more dissolvable components, where the dissolution rate of the dissolvable components is selectively controlled.

SUMMARY OF THE INVENTION

Therefore, in light of the above, and for other reasons that become apparent when the invention is fully described, an object of the present invention is to produce plural component fibers with at least one dissolvable component.

It is another object of the present invention to produce such plural component fibers such that dissolution of the dissolvable component can be selectively controlled.

It is a further object of the present invention to produce plural component fibers with two or more dissolvable components, where the dissolution of each dissolvable component is selectively controllable.

The aforesaid objects are achieved individually and in combination, and it is not intended that the present invention be construed as requiring two or more of the objects to be combined unless expressly required by the claims attached hereto.

In accordance with the present invention, a polymer fiber is formed including at least two sections, where at least one fiber section includes a dissolvable component, and the rate at which at least part of the fiber dissolves is controlled by at least one of: a fiber section having a non-round cross-sectional geometry, and at least two fiber sections including two different dissolvable components. In one embodiment, a fiber section including a dissolvable component may include a plurality of island sections extending in a longitudinal direction of the fiber and separated from each other and at least partially surrounded along the longitudinal dimensions of the island sections by a sea section, where the sea section includes the dissolvable component. The sea section may further include a cross-sectional geometric configuration that is elongated in one or more directions (e.g., ribbon-shaped or tri-lobal). Selection of a suitable non-round cross-sectional geometric configuration for the dissolvable component of the fiber increases the rate of dissolution of the dissolvable component in comparison to a round geometric configuration when exposed to dissolving medium.

In another embodiment, a plural component fiber is formed including a longitudinally extending core section and a longitudinally extending sheath section that at least partially surrounds the core section along the longitudinal dimension of the core section, where the sheath and core sections include different dissolvable components. The different dissolvable components may be selected to have different rates of dissolution when exposed to one or more dissolving mediums so as to control the dissolution of fiber sections for a particular application. Dissolution of selected sections of the plural component fiber may be further controlled by a combination of fiber section geometries including dissolvable components as well as providing different dissolvable components in different fiber sections.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1A:
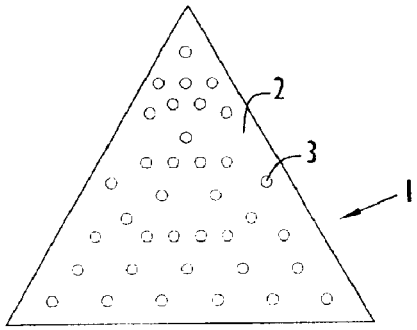
FIGS. 1*a*–1*c* are transverse cross-sectional views of three different embodiments of islands-in-the-sea (I/S) fibers formed in accordance with the present invention.

Plural component fibers with dissolvable components are formed in accordance with the present invention by extrusion of one or mote fibers including plural (i.e., two or more) polymer or other material components, where at least one polymer component is a dissolvable component. The plural component fibers may be islands-in-the-sea (I/S) fibers, in which two or more longitudinally extending island sections are separated from each other by a longitudinally extending sea section, where the island sections may be partially or completely surrounded along their longitudinal dimensions by the sea section. Alternatively, the fibers may be sheath-core fibers, in which at least one longitudinally extending core section is partially or completely surrounded around its longitudinal dimension by at least one longitudinally extending sheath section. For example, a sheath-core fiber may include a single central core section surrounded by a single sheath section or, alternatively, multiple nested sheath sections (i.e., forming a "bulls-eye" cross-sectional configuration as depicted in FIGS. 3 and 4). Other plural component fiber configurations may also be formed in accordance with the present invention including, without limitation, side-by-side and segmented pie configurations.

The plural component fibers formed in the present invention include at least two different components, with at least one component being a dissolvable component that is at least partially dissolvable (i.e., degradable, soluble and/or dispersible) in a dissolving medium. In certain embodiments, the fibers include a second, non-dissolving component that is substantially insoluble in the dissolving medium. Alternatively, the second component can also be a dissolvable component, where the second dissolvable component is dissolvable in the same or different dissolving medium as the first component.

Exemplary dissolvable components include, without limitation, polystyrene (soluble in organic solvents); polyvinyl alcohol or PVA (soluble in water); water-soluble vinyl acetate resins; polyethylene terephthalate modified with a sulfonated isocyanate and commonly referred to as easy soluble polyester or ESPET (soluble in sodium hydroxide and commercially available from Kuraray Co., LTD., Osaka, Japan), and combinations thereof. These polymers may further be modified with suitable additives that alter the rate of dissolution of the polymers.

Additional dissolvable components include biodegradable polymers that are useful in medical applications and degrade and/or become soluble in water. Such biodegradable polymers are suitable for use in medical applications. Dissolvable components that are biodegradable may include synthesized polymers having functional groups such as esters, anhydrides, orthoesters, and amides. Exemplary dissolvable components that are biodegradable and suitable for medical applications include, without limitation, poly(lactic) acid and polylactides (PLA); polyglycolides (PGA); trimethylene carbonates (TMC); polyglyconates (i.e., copolymers of PGA and TMC); poly(e-caprolactone) (PCL); poly (dioxanone) (PDO); and combinations thereof. Copolymer combinations of these biodegradable polymers can also be synthesized to vary the rate of degradation and dissolution of the resultant dissolvable component when exposed to a suitable dissolving medium. For example, varying the composition of a PLA-PGA copolymer will affect the copolymer's rate of degradation and/or dissolution in comparison to other PLA-PGA compositions as well as PLA and PGA homopolymer compositions. Thus, a variety of biodegradable homo- or copolymer compositions are available to form any selected number of dissolvable components having desired rates of dissolution for a particular medical application.

It is to be understood that the term "dissolvable component", as used herein, refers to any of the previously noted biodegradable and/or soluble polymers as described above, where two or more dissolvable components are different if they contain different homopolymer, copolymer and/or additive compositions that effect a different rate of dissolution for the dissolvable components.

Exemplary non-dissolving components include, without limitation, polyesters such as polyethylene terephthalate (PET), polyethylene naphthalate (PEN), polytrimethylene terephthalate (PTT) and polybutylene terephthalate (PBT); polyurethanes; polycarbonates; polyamides such as Nylon 6, Nylon 6,6 and Nylon 6,10; polyolefins such as polyethylene and polypropylene; and any combinations thereof. Any combination of the previously described dissolving and/or non-dissolving components may be utilized in forming the plural component fibers.

In accordance with the present invention, the rate of dissolution of one or more sections of a plural component fiber is controlled by selection of a suitable cross-sectional geometry for a section of the fiber including a dissolvable component as described below. Alternatively, or in combination with cross-sectional geometry selection, the rate of dissolution of at least part of a plural component fiber is also controlled by selection of two or more different dissolvable components for different sections of the fiber. It is noted that, unless otherwise indicated, the term "cross-section", as used herein, refers to the transverse cross-section of the fiber and/or a section of the fiber including a dissolvable component.

Selection of a suitable non-round cross-sectional geometry for a fiber section including a dissolvable component will result in an increase in the rate of dissolution of the dissolvable component in comparison to a conventional round cross-sectional geometry when exposed to a dissolving medium. In particular, a greater deviation from a round cross-sectional geometry facilitates a greater surface area for exposure of the fiber section including the dissolvable component to the dissolving medium and a corresponding reduction in the distance in which dissolution medium must penetrate the dissolvable component, which in turn increases the rate of dissolution of the dissolvable component.

The roundness of the dissolvable component fiber section is defined herein as the ratio of the cross-sectional area of the fiber and/or dissolvable component fiber section to the area of the smallest circle that can be circumscribed around or is substantially contiguous with the cross-sectional perimeter of the fiber and/or dissolvable component fiber section. A cross-sectional geometry that is, for example, round or circular, would have a roundness ratio of 1, whereas a cross-sectional geometry that deviates from circular (e.g., elongated and/or rectangular) would have a roundness ratio that is less than 1. Accordingly, the term "non-round", as used herein, refers to a cross-sectional dimension of a fiber and/or a dissolvable component fiber section that has a roundness ratio of less than 1. The term "round", as used herein, refers to a cross-sectional dimension of a fiber and/or a dissolvable component fiber section that has a roundness ratio of 1.

In particular, fibers having dissolvable components with cross-sectional geometries defined by an aspect ratio and/or modification ratio greater than 1 are preferred, as these geometries provide greater surface area exposure of the dissolvable component fiber sections to the dissolution medium. The aspect ratio is defined herein as the ratio of the largest cross-sectional dimension (e.g., length) to the smallest cross-sectional dimension (e.g., width) of the fiber and/or fiber section including a dissolvable component. The modification ratio is defined herein as the ratio of the diameter of the smallest circle that can circumscribe the cross-sectional dimension of the fiber and/or a fiber section including a dissolvable component to the diameter of the largest circle that can be inscribed within such cross-sectional dimension. Preferably, the cross-section of a fiber and/or dissolvable component section is selected having an aspect ratio and/or modification ratio greater than about 2.

Figure 1B:
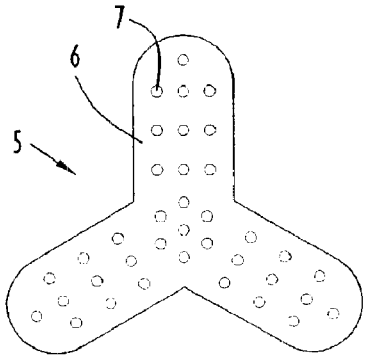
Figure 1C:
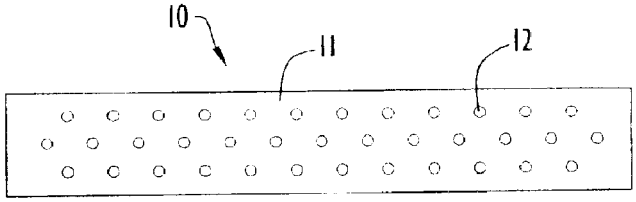

Deviation of fiber cross-sectional geometry from roundness is particularly beneficial when manufacturing ultra-fine fibers from I/S fibers. Exemplary embodiments of I/S fibers with non-round sea sections are depicted in FIGS. 1*a*–1*c*. Specifically, FIG. 1*a* depicts a fiber 1 with a sea section 2 having a triangular cross-section and island sections 3 disposed within the sea section. FIG. 1*b* depicts another I/S fiber 5 with a sea section 6 having a tri-lobal cross section (modification ratio of about 3) and island sections 7 disposed therein, and FIG. 1*c* depicts an I/S fiber 10 with a sea section 11 having an elongated and rectangular or ribbon-shaped cross section (aspect ratio of about 5) and island sections 12 disposed therein.

Such sea section cross-sectional geometries increase the sea section capacity and permit a higher concentration of island sections in the fiber while minimizing damage to island sections during dissolution of the sea section. In particular, as the cross-sectional geometry of the sea section becomes more elongated in one or more directions, as in the ribbon-shaped and tri-lobal configurations of FIGS. 1*b* and 1*c*, the exposed surface area of the sea section correspondingly increases and the maximum depth to which the dissolving medium must penetrate the sea section decreases. This becomes highly advantageous in situations where it is desirable to dissolve the sea section and separate the island sections as quickly as possible. For example, when forming conventional round I/S fibers with ESPET sea sections and PET island sections, the time required to completely dissolve the sea sections for the fibers can be detrimental to the island sections, which also dissolve in the solvent at a slower rate than the sea sections. By modifying the I/S fiber to a non-round geometry, preferably with an aspect and/or modification ratio greater than about 2, the sea sections will dissolve at a faster rate to reduce the exposure time of island sections to the solvent. In addition, the non-round sea section geometry minimizes difficulties associated with dissolving away the sea section of an I/S fiber when the sea section includes a high concentration of island sections.

The I/S fibers formed in accordance with the present invention facilitate the production of ultra-fine fibers (e.g., fibers with diameters in the range of microns or nanometers) upon dissolution of the sea section. It is to be understood that an I/S fiber can be formed in accordance with the present invention as containing two or more island sections. However, the number of island sections per fiber will typically range from at least about 10 to about several hundreds or even thousands of island sections. An exemplary I/S fiber used to form ultra-fine fibers for textile applications consists of a 2 denier fiber with 37 island sections, where the sea section constitutes about 30% of the fiber, which yields ultra-fine fibers of about 0.04 denier per fiber (dpf).

Utilizing non-round I/S cross-sectional configurations such as those depicted in FIGS. 1*a*–1*c*, a greater rate of dissolution of the sea section can be achieved in comparison to conventional I/S fibers with round or circular cross-sectional configurations. To clearly demonstrate the faster rates of dissolution of I/S fibers formed in accordance with the present invention, a ribbonshaped I/S fiber having a cross-section similar to the fiber depicted in FIG. 1*c* was manufactured and compared with a conventional I/S fiber having a circular cross-section. The cross-sectional dimensions of the ribbon-shaped fiber were 13 microns (i.e., width) by 34 microns (i.e., length) (aspect ratio of about 2.6), and the diameter of the round fiber was 24 microns. Each I/S fiber included a water soluble vinyl acetate resin sea section and 64 polypropylene island sections to yield extruded I/S fibers of about 4 dpf.

The fibers were soaked in 70° C. water for a sufficient period of time to substantially dissolve the sea sections of the fibers. At selected time intervals, the fibers were removed and subjected to microscopic analysis to determine the degree to which the sea section had dissolved. The results are as follows: after 30 seconds in the water, a majority (about 75%) of the sea section for the ribbon-shaped fiber had dissolved, whereas only a small portion (about 30%) of the sea section of the circular fiber had dissolved; after 4 minutes in the water, the sea section of the ribbon-shaped fiber had completely dissolved, whereas a small portion (about 25%) of the sea section of the circular fiber still remained; after 8 minutes, the sea section of the circular fiber had completely dissolved. This demonstration indicates that fiber sections including dissolvable components and having non-round cross-sections dissolve at a faster rate than fibers with round sections including dissolvable components. In particular, a fiber that includes a dissolvable component section having a cross-section with a high aspect ratio (e.g., greater than about 2), such as the ribbon-shaped I/S fiber, can yield substantial dissolution of the dissolvable component in about half the time required to substantially dissolve the same dissolvable component in a conventional, round or circular shaped fiber having the same or similar denier.

Modifying the rate of dissolution of dissolvable components in fiber sections is also achieved in accordance with the present invention by combining two or more different dissolvable components in the fiber in a suitable configuration to modify the rate at which sections of the fiber dissolve when exposed to a dissolving medium. A plural component fiber with two or more different dissolvable components having different rates of dissolution is particularly useful in certain medical applications as described below. Any suitable combination of dissolvable components, such as combinations of biodegradable homo- or copolymers as described above, can be selected when forming the plural component fiber to achieve different rates of dissolution for sections of the fiber. Plural component fibers employing different dissolvable components in different fiber sections can be manufactured to produce a variety of different products. For example, in the medical field, such fibers could be used to form medical products and devices such as sutures, vascular grafts, stents, orthopedic fixation devices, tissue engineering connective or scaffold devices, etc.

Figure 2:
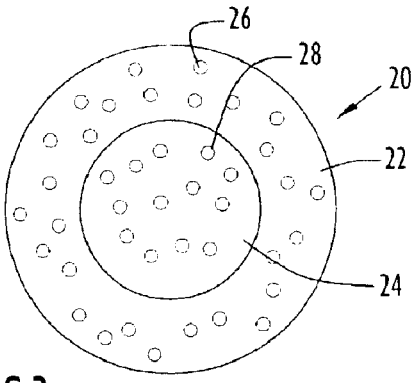
FIG. 2 is a transverse cross-sectional view of an embodiment of sheath-core islands-in-the-sea (I/S) fiber formed in accordance with the present invention.

An exemplary embodiment of a plural component fiber useful for medical applications and having different dissolvable components is depicted in FIG. 2. Specifically, fiber 20 has a sheath-core cross-sectional configuration, with a sheath section 22 surrounding the longitudinal perimeter of a central core section 24 of the fiber. Each of the sheath and core sections includes a number of island sections 26 and 28 having cross-sectional dimensions (e.g., diameters) on the order of microns and/or nanometers. However, it is noted that the cross-sectional dimensions of the island sections and the sheath and core sections may be of any suitable size depending upon the particular use for the fiber. The island sections include a non-dissolving component (e.g., polyethylene or polypropylene), whereas the sheath and core portions include different dissolvable components (e.g., different homo- or copolymer blends of PLA). Alternatively, the island sections may include dissolvable components (e.g., other homo- or copolymer blends of PLA) that dissolve at a slower rate than the dissolvable components of the sheath and core sections.

Fiber 20 may be useful in medical applications (e.g., vascular grafts) where it is desirable to expose island sections in the sheath at a different rate than in the core after surgical implantation of the fiber. For example, dissolvable components for the sheath and core sections can be selected such that the dissolvable component of core section 24 dissolves at a slower rate than the dissolvable component of sheath section 22. Alternatively, in medical applications where a slow rate of dissolution is initially desired in the sheath section, followed by an increased rate of dissolution at the core section, the dissolvable components can be selected accordingly to achieve such effect.

In addition to the fiber embodiments described above, the dissolvable components of the plural component fibers may include a suitable agent dispersed throughout one or more fiber sections. Fibers may be formed with one or more dissolvable component sections, with agents being dispersed within the dissolvable components. For example, agent material may be dispersed within island sections and/or the sea section of an I/S fiber, where the island and sea sections of the I/S fiber include a dissolvable component. Alternatively, or in combination with an I/S fiber configuration, fibers may be formed including sheath and core sections, with agent material dispersed within the sheath and/or core sections.

Exemplary agents include, without limitation, compositions that interact with tissue or bodily fluids to treat or prevent disease or damage, cause a pharmacological or physiologic response, or provide some other beneficial or therapeutic effect (e.g., analgesics, anesthetics, anorexics, anthemidines, antiarthritics, antiasthmatic agents, anticonvulsants, antidepressants, antidiabetic agents, antidiarrhetics, antihistamines, antiinflammatory agents, antimigraine agents, antimotion sickness agents, antinauseants, antineoplastics, antiparkinsonism drugs, antipruitics, antipsychotics, antipyretics, antispasmodics including gastrointestinal and urinary, anticholinergics, sympathomimetics, xanthine derivatives, cardiovascular preparations including calcium channel blockers, betablockers, antiarrythmics, antihypertensives, diuretics, vasodilators, including coronary peripheral, and cerebral, central nervous stimulants, decongestants, diagnostic agents, hormones, hypnotics, immunosuppressives, muscle relaxants, parasympathomimetics, psychostimulants, sedatives, tranquilizers, agents to ease symptoms of addiction, and the like, and combinations thereof). Agent material may be provided in any suitable form within the dissolvable component (e.g., as a particulate solid, a gel and/or a liquid).

Figure 3A:
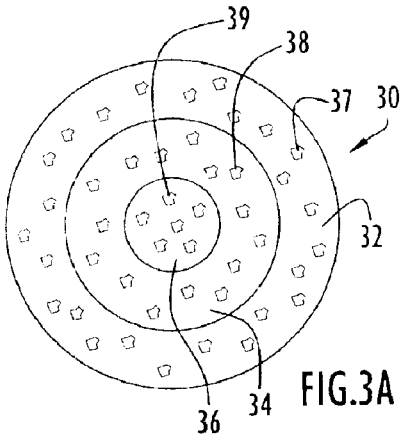
FIGS. 3*a* and 3*b* are transverse cross-sectional views of two embodiments of sheath-core fibers with multiple sheath sections formed in accordance with the present invention.
Figure 3B:
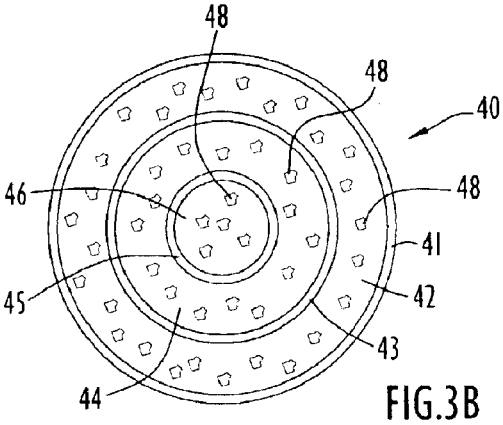
Figure 4:
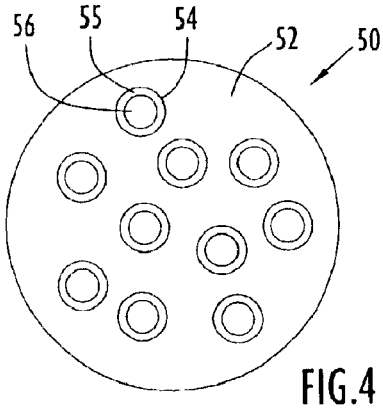
FIG. 4 is a transverse cross-sectional view of an embodiment of an islands-in-the-sea (I/S) fiber formed in accordance with the present invention.

In further embodiments of the present invention, plural component fibers are produced including sheath-core configurations with a series of nested sheath sections or layers and a central core as depicted in FIGS. 3*a* and 3*b*. In particular, FIG. 3*a* depicts a cross-section of a fiber 30 including a core section 36 surrounded along its longitudinal perimeter by an intermediate layer or sheath section 34, which in turn is surrounded along its longitudinal perimeter by an outer sheath section 32. The intermediate sheath section, the outer sheath section and the core section of fiber 30 include suitable agent materials 37, 38 and 39, such as those described above, which can be the same or different and are selected based upon a particular application of the fiber. Each of the core and sheath sections further includes a dissolvable component that is selected based upon the particular application of the fiber. For example, the dissolvable components for the core, intermediate and outer sheaths may have different rates of dissolution to yield a controlled release of agents from each of the layered sheath and core sections of the fiber when the fiber is exposed to a dissolving medium (e.g., water and/or a bodily fluid).

Fiber 40, depicted in FIG. 3*b*, includes a central core section 46 longitudinally surrounded by concentrically nested sheath sections 41, 42, 43, 44 and 45 that form a series of layers disposed at different radial positions from the center of the fiber. While the sheath sections are depicted as being concentrically aligned, one or more sheath sections may alternatively be eccentrically arranged within the fiber. Each sheath section includes a dissolvable component, with adjacent sheath sections having different dissolvable components. In particular, outer sheath section 41 and sheath sections 43 and 45 include a first dissolvable component, whereas core section 46 and sheath sections 42 and 44 include a second dissolvable component. An agent material 48 is also dispersed throughout core section 46 and sheath sections 42 and 44. The first and second dissolvable components may be selected, for example, such that the second dissolvable component has a dissolution rate that is greater than the dissolution rate of the first dissolvable component when the fiber is exposed to a suitable dissolving medium (e.g., water and/or a bodily fluid). Thus, fiber 40 is useful for medical and other applications in which a controlled release of one or more particular agents is periodically required to achieve a therapeutic, anesthetic, or other desired effect.

In yet another embodiment depicted in FIG. 4, an I/S fiber 50 includes a number of island sections 54 surrounded along their longitudinal dimensions by a sea section 52, where the sea section includes a first dissolvable component. Each island section 54 further includes a sheath section 55 and a core section 56, where at least one of the sheath and core sections of the island sections also includes a second dissolvable component that is different from the first dissolvable component of the sea section. For example, the sheath section 55 of an island section 54 may include a second dissolvable component which dissolves at a slower rate than the first dissolvable component of sea section 52. Alternatively, the core section of each island section may include the second dissolvable component, while the sheath sections include non-dissolving components, so as to yield hollow tubes upon dissolution of the fiber sea sections and island-core sections. In addition, agent materials (not shown) may also be provided within any of the sheath and core sections of the island sections as well as the sea section to yield a fiber that provides a selected release of agent materials as the portions of the fiber dissolve away. The fiber configuration may further include a sheath/core—I/S configuration (e.g., similar to the embodiment of FIG. 2), where island sections further include sheath and core sections.

Fiber dissolution may also be controlled through selection of different dissolvable components in combination with selection of suitable cross-sectional geometries for the fiber sections including the different dissolvable components. For example, plural component fibers may be formed in accordance with the present invention having nested sheath/core sectional configurations including different dissolvable components, where some or all of the fiber sections have a ribbon-shaped or other selected non-round cross-section. Further, multiple nested sheath sections may be provided that have different cross-sectional geometries and/or different radial thickness dimensions. Depending upon the fiber application, longitudinally extending island sections and/or agent materials may be disposed within any of the sheath or core sections of such a fiber. In addition, and as previously noted, I/S fibers may be formed where both the island and sea sections include different dissolvable components, where the island sections may further include medical agents to produce a controlled rate of release of the agents as the island sections are dissolved.

Figure 5:
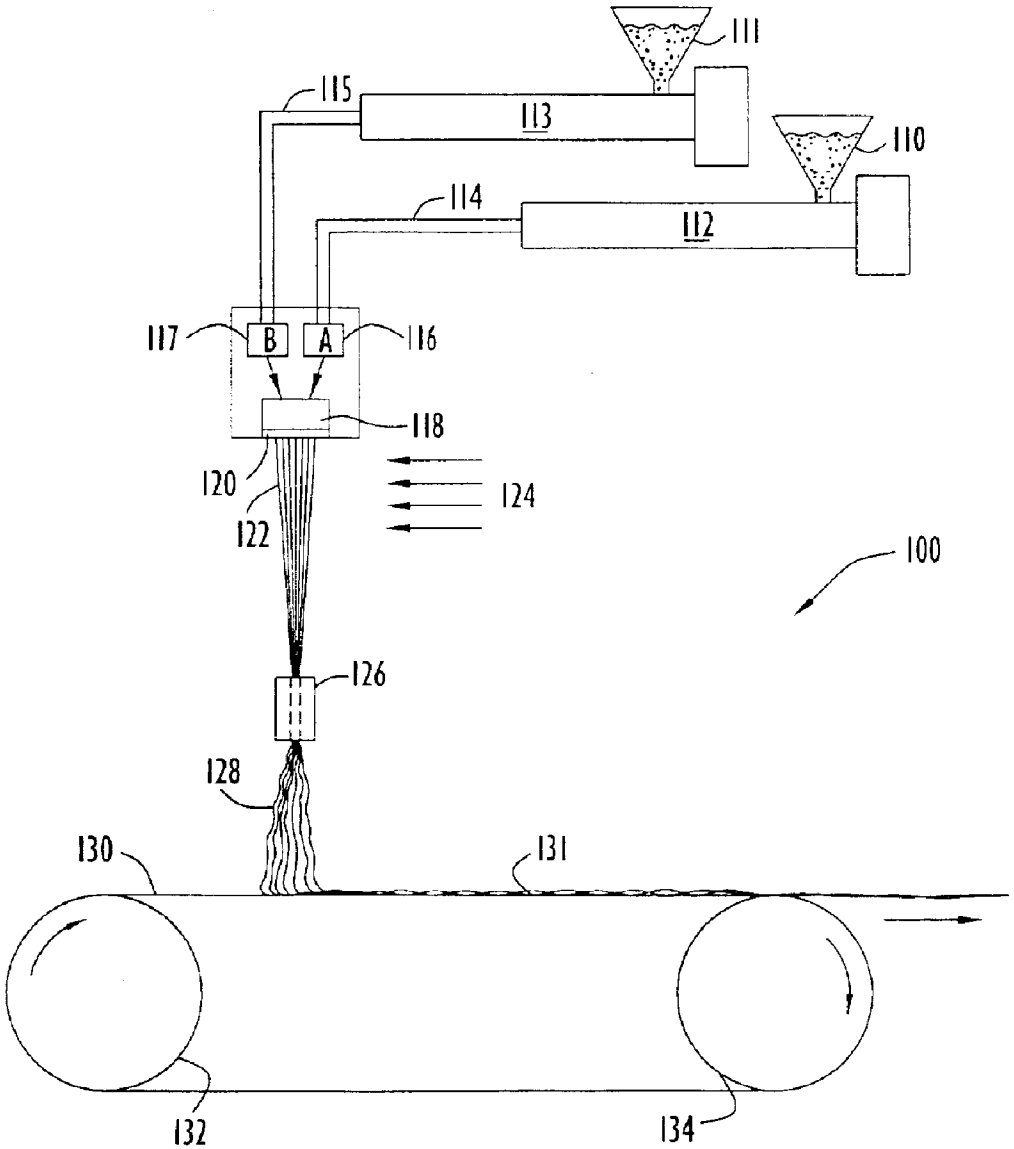
FIG. 5 is a diagrammatic view of a spunbond system for forming plural component fibers in accordance with the present invention.

Plural component fibers, such as any of the fibers described above, can be formed utilizing a spunbond, meltblown or any other suitable fiber extrusion process. An exemplary spunbond process that may be utilized to form the I/S and/or sheath core fibers as described above is illustrated in FIG. 5. System 100 includes a first hopper 110 into which pellets of a polymer component A are placed, where polymer component A includes a dissolvable component or a non-dissolving component. The polymer is fed from hopper 110 to screw extruder 112, where the polymer is melted. The molten polymer flows through heated pipe 114 into metering pump 116 and spin pack 118. A second hopper 111 feeds a polymer component B into a screw extruder 113, which melts the polymer. The polymer component B includes a dissolvable component (e.g., a different dissolvable component than a dissolvable component including in polymer component A). The molten polymer flows through heated pipe 115 and into a metering pump 117 and spin pack 118. Optionally, a suitable agent (e.g., one of the agents described above) may be intermixed with either or both polymer components A and B to achieve any of the fiber combinations as described above. While only two polymer component streams are depicted in FIG. 5, it is noted that the system may be configured for processing any selected number of polymer streams (e.g., three or more) depending upon the desired fiber configuration for a particular application.

Spin pack 118 includes a spinneret 120 with orifices through which islands-in-the-sea fibers 122 are extruded. The design of the spin pack is configured to accommodate multiple dissolvable and non-dissolving components for producing any of the previously noted I/S and/or sheath/core fiber configurations including any desirable non-round cross-sectional geometries for the dissolvable components of the fibers. A suitable spin pack that may be utilized with the system of the present invention is described in U.S. Pat. No. 5,162,074, the disclosure of which is incorporated herein by reference in its entirety. The extruded fibers 122 emerging from the spinneret are quenched with a quenching medium 124 (e.g., air), and are subsequently directed into a drawing unit 126, depicted as an aspirator in FIG. 3, to attenuate the fibers. Alternatively, it is noted that godet rolls or any other suitable drawing unit may be utilized to attenuate the fibers.

Upon exiting the drawing unit 126, the attenuated fibers 128 are laid down on a support surface, depicted in FIG. 3 as a continuous screen belt 130 supported and driven by rolls 132 and 134. The fibers 131 are then directed to a winder roll (not shown). When forming ultra-fine fibers from extruded I/S fibers, the fibers may be treated (in-line prior to winding onto a winder roll or at another station after winding) in a suitable dissolving medium to dissolve the dissolvable sea sections from the island sections.

The present invention is not limited to the particular systems and processes described above. Rather, any suitable plural component fiber may be produced in accordance with the present invention that includes at least one dissolvable component and a suitable non-round geometry and/or two or more sections of the fiber including different dissolvable components, such that the rate of dissolution of one or more sections of the fiber can be selectively controlled. Any suitable plural component fiber configurations may be formed including, without limitation, I/S configurations, single or multiple nested sheath/core configurations, side-by-side configurations, segmented pie configurations, and any suitable combinations thereof. Further, any one or more dissolvable, non-dissolving components, and/or agent materials may be included in any of the fiber sections.

For example, a fiber configuration including a core section and a sheath section may include a dissolvable component in the sheath section and a non-dissolving component in the core section, with agent materials disposed in one or more channels of the core to facilitate release of the agent materials from the non-dissolving core section once the sheath section has been sufficiently dissolved away from the core section. Similarly, an US fiber may also be formed with a dissolvable component in the sea section and non-dissolving components in the island sections, where the island sections include channels with agent materials dispersed therein to facilitate release of the agent materials upon dissolution of the sea section.

Having described preferred embodiments of controlling dissolution of dissolvable polymer components in plural component fibers, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A polymer fiber comprising at least two dissolvable sections, wherein the rate at which at least part of the fiber dissolves is controlled at least in part by providing different dissolvable components in the at least two dissolvable sections that are at least partially soluble in the same dissolving medium.

2. The fiber of claim 1, further comprising a plurality of island sections extending in a longitudinal direction of the fiber and separated from each other and at least partially surrounded along the longitudinal dimensions of the island sections by a sea section, wherein the sea section includes one or more dissolvable components.

3. The fiber of claim 2, wherein the fiber includes at least 10 island sections.

4. The fiber of claim 2, wherein the cross-sectional geometry of the sea section is elongated and has an aspect ratio greater than 1.

5. The fiber of claim 2, wherein the sea section includes one of a ribbon-shaped cross-section and a tri-lobal cross-section.

6. The fiber of claim 2, wherein an agent material is dispersed through at least one of the island sections and the sea section.

7. The fiber of claim 2, wherein the island sections include a dissolvable component that is different from the dissolvable component of the sea section.

8. The fiber of claim 1, further comprising a longitudinally extending core section and a longitudinally extending sheath section that at least partially surrounds the core section along the longitudinal dimension of the core section, wherein the sheath and core sections include different dissolvable components and the core section is disposed along a central axis of the fiber.

9. The fiber of claim 8, further comprising a plurality of island sections extending in a longitudinal direction of the fiber and separated from each other within at least one of the sheath and core sections.

10. The fiber of claim 8, further comprising an agent material dispersed within at least one of the island, sheath and core sections.

11. The fiber of claim 8, further comprising a plurality of consecutively aligned sheath sections disposed at increasing radial positions from the core section, wherein each core and sheath section includes a dissolvable component that differs from the dissolvable component of an adjacent core or sheath section.

12. The fiber of claim 11, wherein at least one of the core and sheath sections includes an agent material dispersed therein.

13. A medical device comprising the fiber of claim 1.

14. A polymer fiber comprising a plurality of longitudinally extending and successively nested sections, wherein at least two nested sections are dissolvable and include at least one of a plurality of longitudinally extending island sections and a dispersed agent material.

15. The fiber of claim 14, wherein adjacent nested sections include different dissolvable components.

16. The fiber of claim 14, wherein at least one of a plurality of longitudinally extending island sections and a dispersed agent material is disposed in successively alternating nested sections.

17. A polymer fiber comprising at least two dissolvable sections including different dissolvable components, the different dissolvable components being at least partially soluble in the same dissolving medium, wherein the rate at which at least part of the fiber dissolves is controlled at least in part by a dissolvable section having a non-round cross-sectional geometry.

18. The fiber of claim 17, wherein the cross-sectional geometry is one of a ribbon-shaped cross-section and a tri-lobal cross-section.

19. A polymer fiber comprising at least two sections, wherein at least one fiber section includes a dissolvable component, and the rate at which at least part of the fiber dissolves is controlled at least in part by providing a fiber section including the dissolvable component with an elongated cross-sectional geometry that has an aspect ratio greater than about 2.

20. The polymer fiber of claim 19, wherein the fiber section including the component has a ribbon-shaped cross-section.

21. The polymer fiber of claim 19, further comprising a plurality of island sections extending in a longitudinal direction of the fiber and separated from each other and at least partially surrounded along the longitudinal dimensions of the island sections by a sea section, wherein the sea section that includes the dissolvable component.

* * * * *